US006691683B2

(12) United States Patent
Gracyalny et al.

(10) Patent No.: US 6,691,683 B2
(45) Date of Patent: Feb. 17, 2004

(54) AUTOMATIC FUEL VENT CLOSURE AND FUEL SHUTOFF APPARATUS HAVING ELECTRICAL ACTUATION

(75) Inventors: Gary J. Gracyalny, Milwaukee, WI (US); John H. Thiermann, Greenfield, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 10/023,244

(22) Filed: Dec. 13, 2001

(65) Prior Publication Data

US 2002/0139355 A1 Oct. 3, 2002

Related U.S. Application Data

(60) Provisional application No. 60/279,284, filed on Mar. 28, 2001.

(51) Int. Cl.[7] ..... F02M 37/04

(52) U.S. Cl. ..... 123/516; 123/198 D; 123/179.17

(58) Field of Search ..... 1233/198 D, 198 F, 1233/516, 518, 520, 179.17

(56) References Cited

U.S. PATENT DOCUMENTS

| | | | | |
|---|---|---|---|---|
| 1,473,303 A | | 11/1923 | Lightford | |
| 2,131,811 A | | 10/1938 | Kittredge | |
| 2,358,840 A | | 9/1944 | Walker | |
| 2,706,025 A | | 4/1955 | Halttunen | |
| 3,391,679 A | | 7/1968 | Williams et al. | |
| 3,601,107 A | | 8/1971 | Rohrbacher et al. | |
| 3,610,220 A | | 10/1971 | Yamada et al. | |
| 3,610,221 A | | 10/1971 | Stoltman | |
| 3,617,034 A | | 11/1971 | Skinner | |
| 3,645,244 A | | 2/1972 | Seyfarth | |
| 3,650,256 A | | 3/1972 | Marshall | |
| 3,653,537 A | | 4/1972 | Shiobara et al. | |
| 3,678,912 A | | 7/1972 | Hensler | |
| 3,696,799 A | | 10/1972 | Gauck | |
| 3,703,165 A | | 11/1972 | Hansen | |
| 3,731,663 A | | 5/1973 | Hollins | |
| 3,779,224 A | | 12/1973 | Tagawa et al. | |
| 3,844,264 A | | 10/1974 | Grainger | |
| 3,897,771 A | | 8/1975 | Stumpp | |
| 3,952,719 A | | 4/1976 | Fenton et al. | |
| 4,050,436 A | | 9/1977 | Crabtree | |
| 4,077,381 A | | 3/1978 | Firey | |
| 4,078,536 A | | 3/1978 | Ozawa et al. | |
| 4,111,175 A | | 9/1978 | Nakamura et al. | |
| 4,111,176 A | | 9/1978 | Fenton et al. | |
| 4,161,639 A | | 7/1979 | Nofel | |
| 4,175,630 A | | 11/1979 | Fleisher et al. | |
| 4,178,894 A | | 12/1979 | Nau | |
| 4,198,816 A | | 4/1980 | Hasegawa et al. | |
| 4,285,440 A | * | 8/1981 | Adams | 220/202 |
| 4,368,618 A | * | 1/1983 | Nave | 60/39.281 |
| 4,414,162 A | | 11/1983 | Ii et al. | |
| 4,416,108 A | | 11/1983 | Ghandhi | |
| 4,421,089 A | * | 12/1983 | Moore, Jr. | 123/454 |
| 4,454,783 A | | 6/1984 | Sierk et al. | |

(List continued on next page.)

*Primary Examiner*—Carl S. Miller
(74) *Attorney, Agent, or Firm*—Michael Best & Friedrich LLP

(57) ABSTRACT

A device including an internal combustion engine, an engine control device coupled to the internal combustion engine and manually operable to stop operation of the engine, a fuel tank coupled to the engine for providing fuel to the engine, and a fuel vent closure device communicating with the fuel tank. The fuel vent closure device is automatically and electrically operable in response to the manual operation of the engine control device to substantially seal the fuel tank when the engine is stopped, thereby substantially preventing emissions from the fuel tank. The device also preferably includes a fuel shutoff device automatically and electrically operable in response to the manual operation of the engine control device to substantially block the supply of fuel to the engine when the engine is stopped.

50 Claims, 15 Drawing Sheets

U.S. PATENT DOCUMENTS

| | | | | |
|---|---|---|---|---|
| 4,510,739 | A | | 4/1985 | Dluhosch |
| 4,577,597 | A | | 3/1986 | Tomita |
| 4,633,843 | A | | 1/1987 | Wissmann et al. |
| 4,694,810 | A | | 9/1987 | Miyamoto |
| 4,924,827 | A | | 5/1990 | Minegishi |
| 4,981,120 | A | * | 1/1991 | Mangum, Jr. ..... 123/178 F |
| 5,003,948 | A | * | 4/1991 | Churchill et al. ..... 123/352 |
| 5,050,548 | A | * | 9/1991 | Minegishi ..... 123/198 D |
| 5,092,295 | A | | 3/1992 | Kobayashi |
| 5,203,306 | A | | 4/1993 | Billingsley et al. |
| 5,301,644 | A | | 4/1994 | Olmr |
| 5,357,935 | A | | 10/1994 | Oxley et al. |
| 5,408,977 | A | | 4/1995 | Cotton |
| 5,445,121 | A | | 8/1995 | Kai |
| 5,797,374 | A | | 8/1998 | Minagawa et al. |
| 6,082,323 | A | | 7/2000 | Winberg |
| 6,213,083 | B1 | | 4/2001 | Winberg |
| 6,608,393 | B2 | | 8/2003 | Anderson |

* cited by examiner

AUTOMATIC FUEL VENT CLOSURE AND FUEL SHUTOFF APPARATUS HAVING ELECTRICAL ACTUATION

RELATED APPLICATIONS

This application claims priority to U.S. Provisional Patent Application Serial No. 60/279,284 filed Mar. 28, 2001.

FIELD OF THE INVENTION

The present invention relates to the field of internal combustion engines and, more particularly, to electrically-actuated components in the fuel systems of internal combustion engines.

BACKGROUND OF THE INVENTION

Internal combustion engines are used in a variety of applications, such as lawnmowers, generators, pumps, snow blowers, and the like. Such engines usually have fuel tanks coupled thereto to supply fuel to the engine through a supply line. It is desirable to reduce emissions from devices powered by internal combustion engines. Even when the engine is not being used, the engine can release emissions of hydrocarbons or gasoline resulting from daily ambient temperature changes. Such emissions are known as "diurnal" emissions.

To help reduce emissions from the engine, it is known to provide internal combustion engines with fuel shutoff devices that block the flow of fuel to the engine upon engine ignition shutdown. Without such a shutoff device, fuel is wasted, and unburned fuel is released into the environment, thereby increasing hydrocarbon exhaust emissions. Likewise, the presence of unburned fuel in the combustion chamber may cause dieseling. When the engine is not operating, pressure buildup in the fuel tank caused by increased ambient temperatures can force fuel into the engine, where the fuel can be released into the atmosphere.

It is also desirable to reduce emissions from the fuel tank. Fuel tanks are typically vented to the atmosphere to prevent pressure buildup in the tank. While the engine is operating and drawing fuel from the fuel tank, the vent in the fuel tank prevents excessive negative pressure inside the tank. While the engine is not operating (i.e., in times of non-use and storage), the vent prevents excessive positive pressure that can be caused by fuel and fuel vapor expansion inside the tank due to increased ambient temperatures. Fuel vapors are released to the atmosphere, primarily when a slight positive pressure exists in the tank.

One common method of venting fuel tanks includes designing a permanent vent into the fuel tank cap. Typically, the fuel tank is vented via the threads of the screw-on fuel tank cap. Even when the cap is screwed tightly on the tank, the threaded engagement does not provide an air-tight seal. Therefore, the fuel tank is permanently vented to the atmosphere. Another method of venting fuel tanks includes the use of a vent conduit that extends away from the tank to vent vapors to a portion of the engine (i.e., the intake manifold) or to the atmosphere at a location remote from the tank.

SUMMARY OF THE INVENTION

The present invention provides a fuel vent closure device that is actuated automatically by the operation of a manually-operable engine control device such as a deadman or bail lever, a start/stop device such as a button, knob, or key, or a speed control device. In other words, the engine control device, which is already coupled to the ignition circuit to selectively stop and/or start the engine, is also coupled to the vent closure device so that no additional action on behalf of the operator is required to actuate the vent closure device. In fact, the operator may not even know that the manual operation of the engine control device simultaneously actuates the vent closure device.

When the engine control device is remotely located from the engine and the fuel tank (as is the case with a deadman or bail lever on the handle of a walk behind lawnmower), the automatic actuation of both the ignition switch and the vent closure device preferably occurs from a remote location. Linkage assemblies such as bowden cables, levers, cams, and other members, are preferably used to remotely actuate the ignition switch and an electrical actuator coupled to the vent closure device. The electrical actuator may be an electric stepper motor, an electric wax motor, a solenoid, and the like, that is electrically connected to a power source. A power source, such as a battery or magneto, is used to power the electrical actuator.

In one aspect of the invention, the engine control device and the fuel vent closure device are also coupled to an automatic fuel shutoff device that blocks the flow of fuel to the internal combustion engine when the engine stops. Preferably, the single action of manually operating the engine control device causes actuation of each of the vent closure device, the fuel shutoff device, and the engine ignition system. Again, if the engine control device is remote from the engine and the fuel tank, linkages are used to remotely actuate the ignition switch and the electrical actuator or actuators used to actuate the vent closure device and the fuel shutoff device. In a preferred embodiment, a single valve assembly acts as both the fuel vent closure device and the fuel shutoff device, and a single electrical actuator actuates the valve.

Other features and advantages of the invention will become apparent to those skilled in the art upon review of the following detailed description and drawings.

Figure 1:
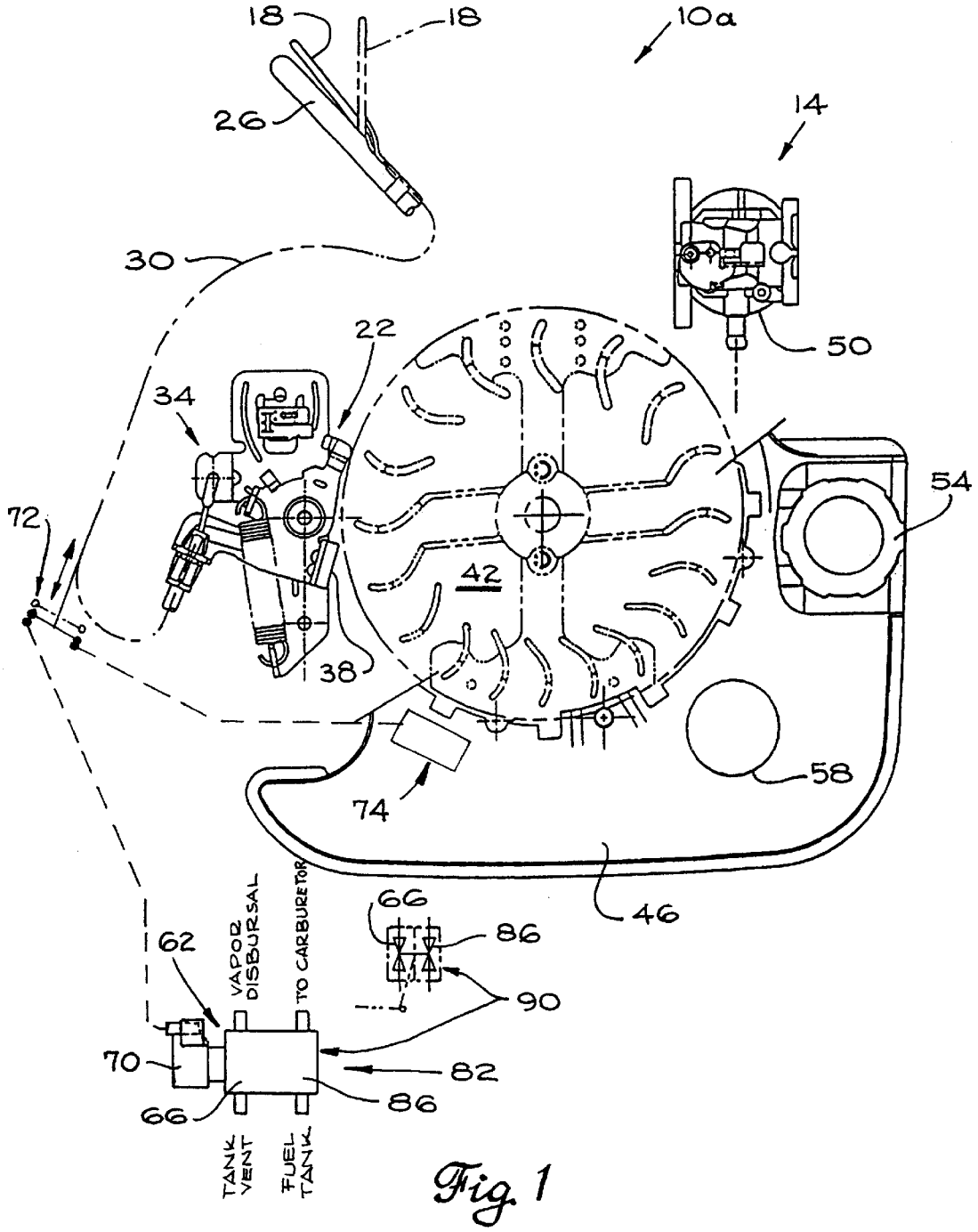
FIG. 1 is a schematic view of an internal-combustion-engine-powered device having a deadman or bail lever coupled to a fuel vent closure and fuel shutoff device embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 24:
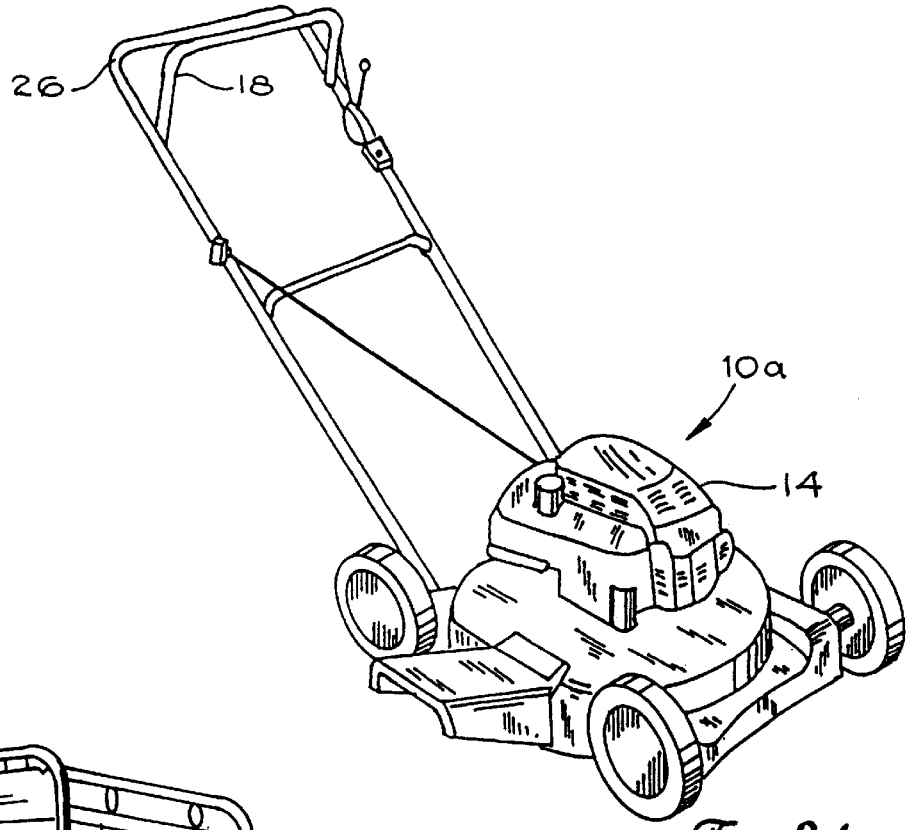
FIG. 24 is a lawnmower having an internal combustion engine embodying the invention.
Figure 25:
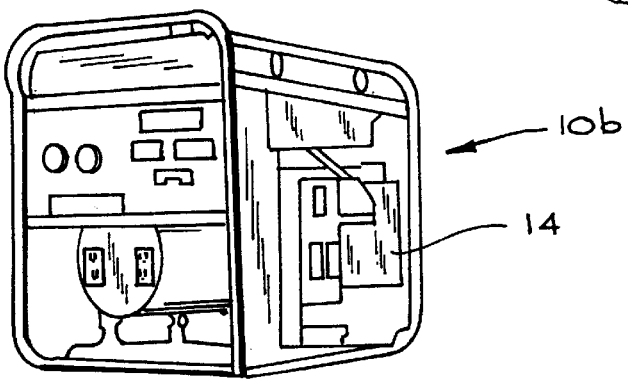
FIG. 25 is a portable generator having an internal combustion engine embodying the invention.
Figure 26:
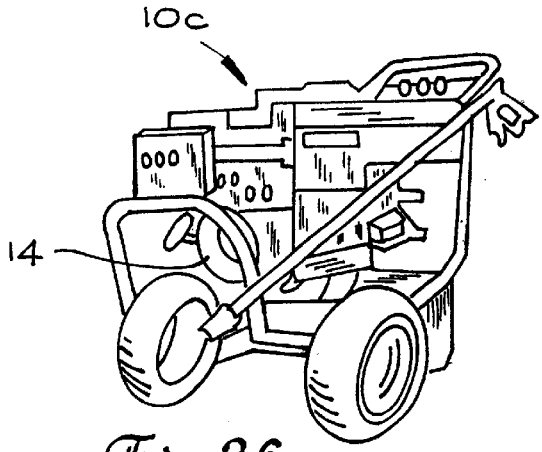
FIG. 26 is a portable pressure washer having an internal combustion engine embodying the invention.
Figure 27:
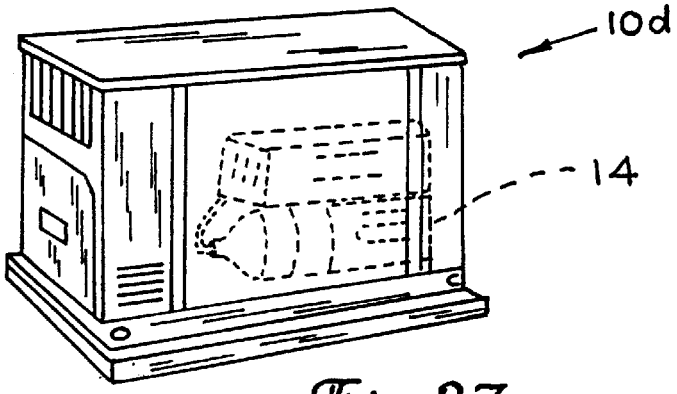
FIG. 27 is an automatic backup power system having an internal combustion engine embodying the invention.
Figure 28:
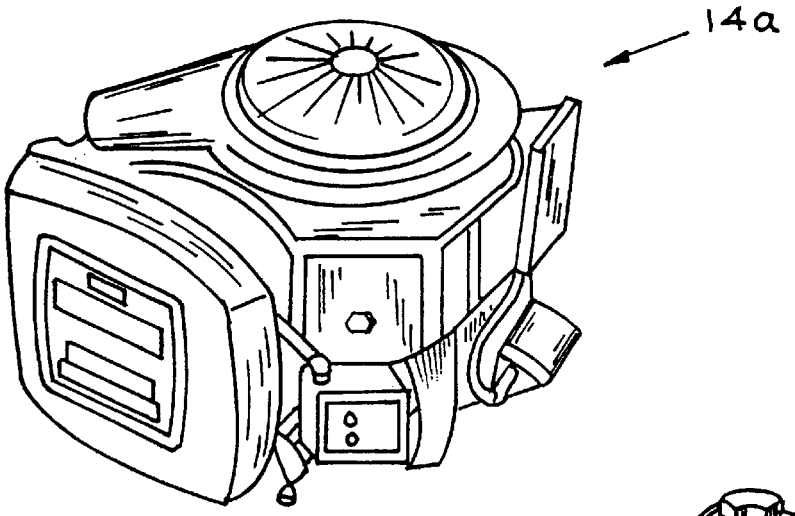
FIG. 28 is a multi-cylinder, V-twin internal combustion engine embodying the invention.
Figure 29:
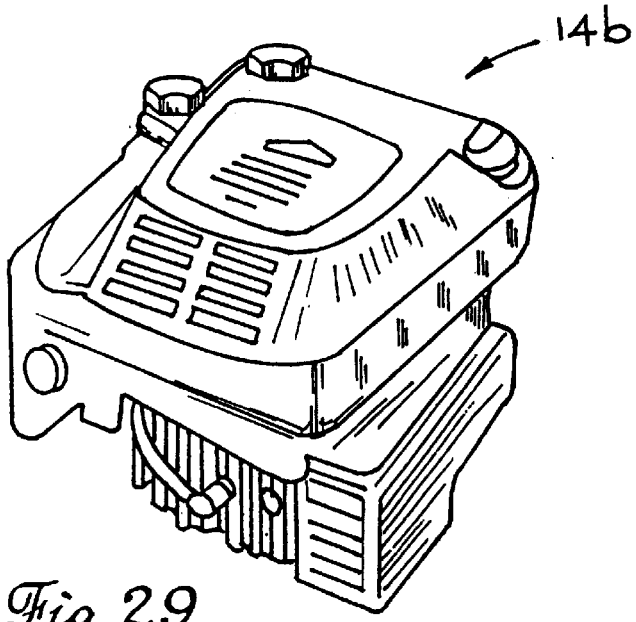
FIG. 29 is a single cylinder internal combustion engine embodying the invention.
Figure 30:
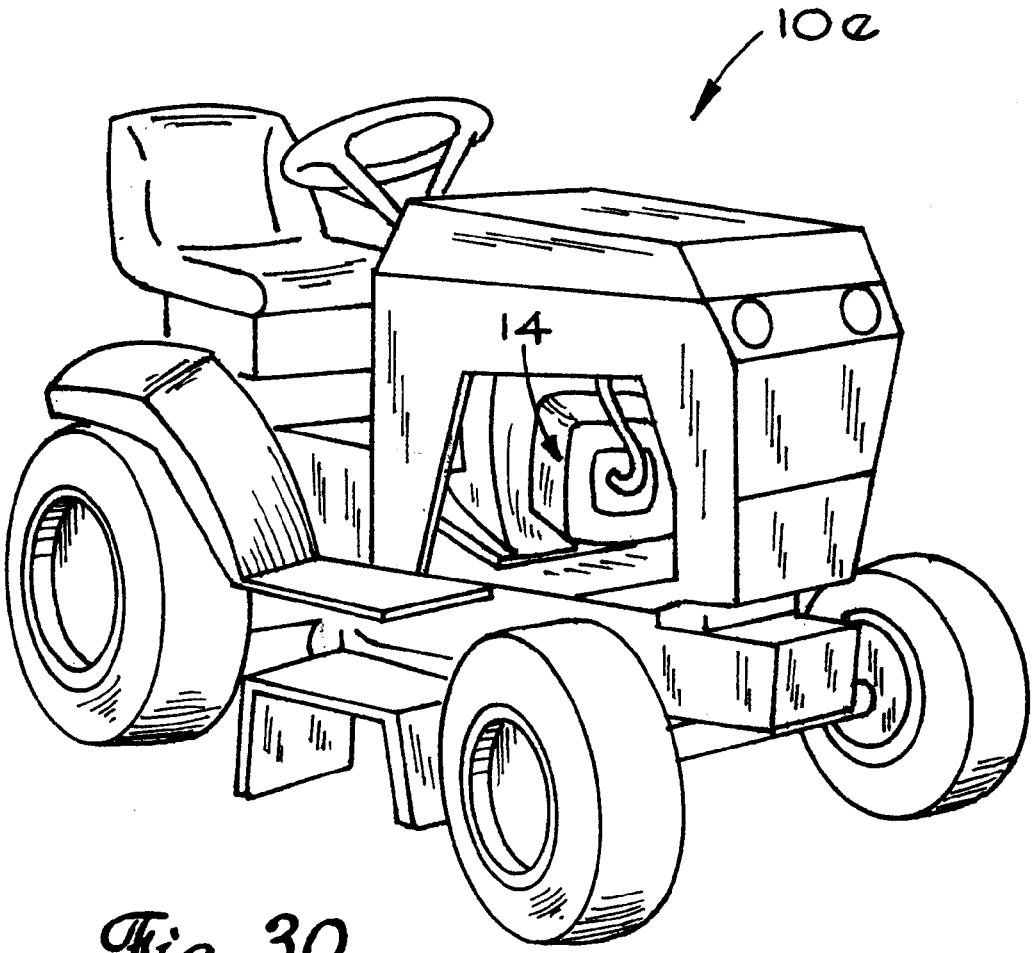
FIG. 30 is a tractor or riding lawnmower having an internal combustion engine embodying the invention.

FIG. 1 schematically illustrates a device 10 having an internal combustion engine 14. In FIG. 1, the device 10 is illustrated as being a lawnmower 10*a* (see FIG. 24), but could alternatively be a snow blower (not shown), a portable generator 10*b* (see FIG. 25), a pump, such as the type commonly used in a portable pressure washer 10*c* (see FIG. 26), a stand-alone generator, such as the type commonly used for an automatic backup power system 10*d* (see FIG. 27), a riding lawnmower or tractor 10*e* (see FIG. 30), or the like. The engine 14 can be a multi-cylinder engine, such as a V-twin or opposed-cylinder engine 14*a* (see FIG. 28), or a single-cylinder engine 14*b* (see FIG. 29).

The lawnmower 10*a* includes an engine control device 18 coupled to the internal combustion engine 14. The engine control device 18 is manually operable to stop operation of the engine 14 by grounding an ignition switch 22. The engine control device 18 shown in FIG. 1 is known as a deadman lever or a bail lever and is mounted on the lawnmower handle 26, remote from the engine 14, as is commonly understood. A bowden cable or other suitable actuator 30 (shown schematically) connects the engine control device 18 to a linkage assembly 34 that actuates the ignition switch 22. Any suitable linkage assembly 34 can be used.

The engine control device 18 can also operate to stop the rotation of the blade (not shown). As seen in FIG. 1, an engine flywheel brake 38 is mounted on the linkage assembly 34. When the deadman lever is released (as shown in phantom in FIG. 1), the linkage assembly 34 is oriented such that the brake 38 engages a flywheel 42. Stopping the rotation of the flywheel 42 stops the rotation of the blade. Other blade braking mechanisms are also known and can be used instead of the engine flywheel brake 38.

The lawnmower 10*a* also includes a fuel tank 46 coupled to the engine 14 for providing fuel to the engine 14. More specifically, the fuel tank 46 supplies fuel to a carburetor 50 as is commonly understood. Of course, the engine 14 could also be a non-carbureted engine, in which case, fuel would be supplied to a fuel injection system. The fuel tank 46 is filled by removing a fill cap 54. Unlike prior art threaded fill caps, the fill cap 54 provides an air-tight seal when closing the fuel tank 46. The fill cap 54 can be configured in any suitable manner to close and seal the tank 46.

The fuel tank 46 also includes a vent 58 (shown schematically in FIG. 1) that can be selectively opened and closed as will be described below. Any suitable vent configuration that permits selective opening and closing can be used. Some examples of vent configurations are shown in FIGS. 5–11. The vent 58 provides selective communication between the inside of the tank 46 and the atmosphere. When the vent 58 is open, the fuel tank 46 communicates with the atmosphere only via the vent 58. When the vent 58 is closed, the fuel tank 46 does not communicate with the atmosphere. Therefore, closing the vent 58 reduces diurnal emissions from the tank 46. The fuel tank 46 may be designed to accommodate pressure fluctuations caused by the expansion of fuel in the tank 46 when the vent 58 is closed.

The lawnmower 10*a* further includes a fuel vent closure device 62 that selectively opens and closes the vent 58. The fuel vent closure device 62 preferably includes a valve 66 (also shown schematically in FIG. 1) communicating between the vent 58 and a fuel vapor disbursal system, such as the air intake to the carburetor. The valve 66 can be of any suitable design. Several possible designs are shown in FIGS. 12–23, which will be discussed below. Opening the valve 66 opens the vent 58, thereby providing communication between the inside of the tank 46 and the atmosphere. Closing the valve 66 closes the vent 58, thereby preventing communication between the inside of the tank 46 and the atmosphere.

To reduce diurnal emissions from the fuel tank 46, the valve 66 should be closed when the engine 14 stops running, and should remain closed until the engine 14 is ready to be run or is running. To accomplish this, the vent closure device 62 is actuated automatically in response to the manual operation of the engine control device 18. In other words, when the operator releases the deadman lever (as shown in phantom in FIG. 1) to close the ignition ground switch 22 and stop the engine 14, the vent closure device 62 automatically closes the valve 66, thereby closing the vent 58. When the operator engages the deadman lever (as shown in solid lines in FIG. 1) to open the ignition ground switch 22 and enable the engine 14 to start, the vent closure device 62 automatically opens the valve 66, thereby opening the vent 58. By incorporating the operation of the vent closure device 62 with the manual operation of the engine control device 18, no additional action to open or close the vent 58 is required on behalf of the operator.

As seen in FIG. 1, the vent closure device 62 is remotely operated in response to actuation of the engine control device 18. More specifically, the vent closure device 62 includes an electrical actuator 70 coupled to the valve 66. The electrical actuator 70 operates in response to actuation of the engine control device 18 to open and close the valve 66. Any suitable linkage, such as the bowden cable 30 and/or the linkage assembly 34, can also actuate an interrupt switch 72 (shown schematically in FIG. 1) that actuates the electrical actuator 70. The electrical actuator 70 can be any suitable electric device, such as an electric motor (e.g., a stepper motor or wax motor) or an electromagnetic actuator (e.g., a solenoid). When the operator actuates the engine control device 18 to close and open the ignition ground switch 22, the interrupt switch 72 is also opened (as shown in phantom in FIG. 1, representing the engine stopped) and closed (as shown in solid lines in FIG. 1, representing the engine running) so that the electrical actuator 70 selectively closes and opens the valve 66.

A power supply 74 (shown schematically in FIG. 1) such as a battery, a capacitive discharge ignition system, or a magneto ignition system is used to power the electrical actuator 70 and is connected in circuit with the interrupt switch 72 and the electrical actuator 70. When the interrupt switch 72 is closed (as shown in solid lines in FIG. 1), the power supply 74 actuates the electrical actuator 70 to open valve 66. When the interrupt switch 72 is opened (as shown in phantom in FIG. 1), power to the electrical actuator 70 terminates and the valve 66 is closed. If a capacitor is used in the power supply 74, the capacitor could be charged by an alternator while the engine 14 is running, as is understood by those of skill in the art.

It is not necessary for the vent closure device 62 to automatically open the vent when the deadman lever is engaged for operation. Rather, the vent closure device 62 could operate automatically to close the vent 58 in response to release of the deadman lever, but could require additional action on behalf of the operator to manually open the vent 58 in order to run the engine 14.

The lawnmower 10*a* also preferably includes a fuel shutoff device 82 that selectively blocks the fuel supply to the carburetor 50. The fuel shutoff device 82 includes a valve 86 communicating between the fuel tank 46 and the carburetor 50. The valve 86 can be of any suitable design. Several possible designs are shown in FIGS. 12–23, which will be discussed below. Opening the valve 86 provides fluid communication between the inside of the tank 46 and the carburetor 50. Closing the valve 86 blocks fluid communication between the inside of the tank 46 and the carburetor 50.

As shown in FIG. 1, the valve 86 for the fuel shutoff device 82 is actuated concurrently with actuation of the valve 66 for the vent closure device 62. The same electrical actuator 70 discussed above with respect to the vent closure device 62 also actuates the fuel shutoff device 82. The specific method of actuation can vary, and several different possibilities are discussed below. Therefore, when the operator manually operates the engine control device 18 by releasing the deadman lever, the engine 14 stops running, the blade stops rotating, the fuel vent 58 is closed, and the fuel supply to the carburetor 50 is blocked. When the operator engages the deadman lever to permit running of the engine 14, the engine 14 can be started, the brake 38 is released, the vent 58 is opened, and the fuel supply to the carburetor 50 is unblocked.

As will be discussed in more detail below, it is possible to incorporate both valves 66 and 86 in a single valve assembly 90, thereby reducing the number of parts on the device. On the other hand, the fuel shutoff device 82 need not be actuated concurrently with, or via the same electrical actuator 70 as the vent closure device 62, and could be completely separate from the vent closure device 62.

Figure 2:
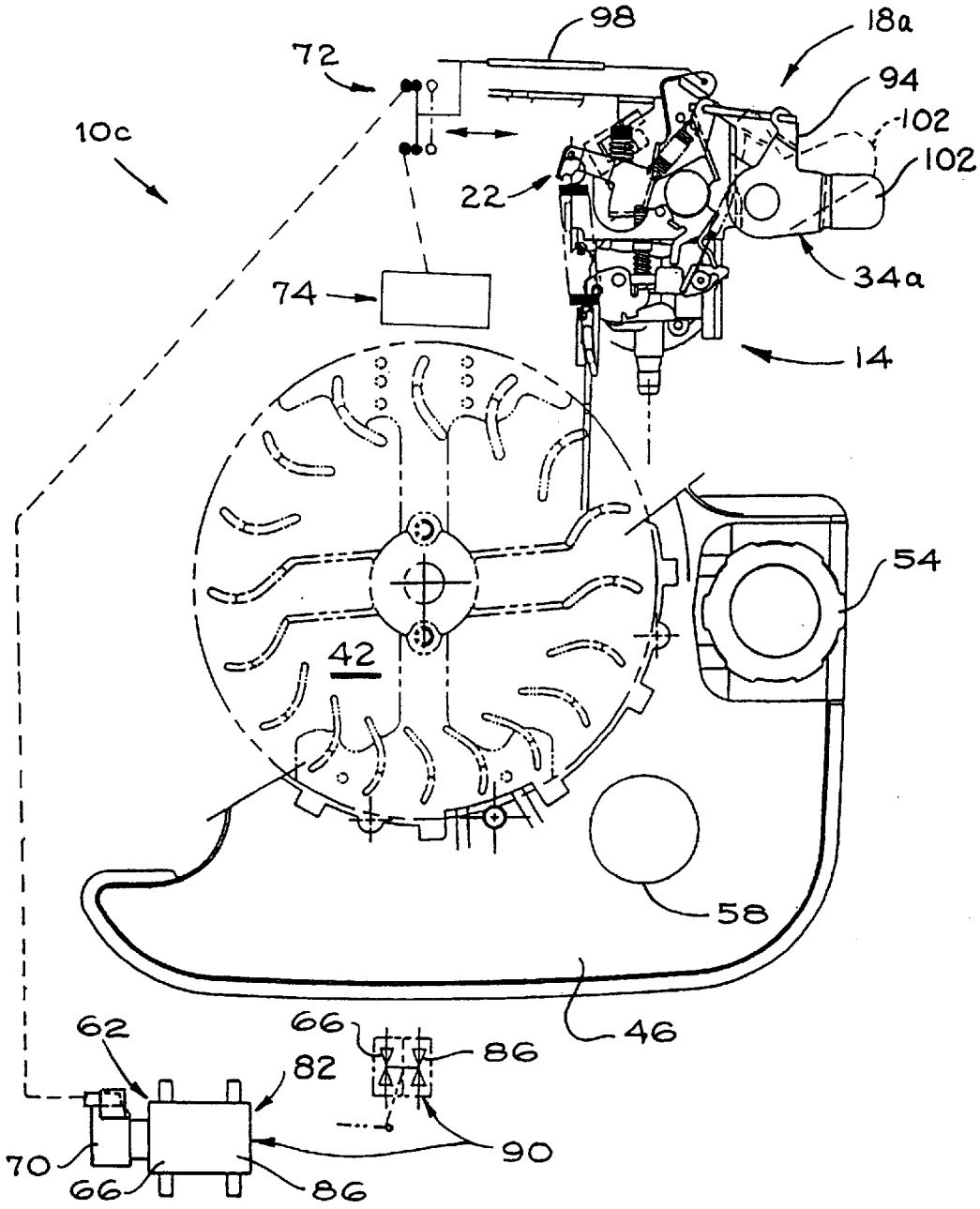
FIG. 2 is a schematic view of an internal-combustion-engine-powered device having an engine speed control device coupled to the fuel vent closure and fuel shutoff device embodying the invention.

FIG. 2 schematically illustrates a device 10*c* that is slightly different than the lawnmower 10*a*. The device 10*c* is illustrated as being a pump or a pressure washer (see FIG. 26), but could alternatively be a generator 10*b* and 10*d* (see FIGS. 25 and 27), a compressor, a snow blower, tiller, string trimmer, or the like. The operation of the device 10*c* is substantially similar to the operation of the lawnmower 10*a*, with some exceptions which will be discussed below. Like parts have been given like reference numerals.

The device 10*c* includes an engine control device 18*a* in the form of a speed control device. The speed control device includes a speed control lever 94 on a linkage assembly 34*a*. The speed control lever 94 can be operated via a remote speed control lever (not shown) attached to a speed control cable 98, or directly via a friction speed control lever 102 extending from the linkage assembly 34*a*. As the device 10*c* does not include a rotating blade, as found in the lawnmower 10*a*, no brake is needed.

The fuel vent closure device 62 and the fuel shutoff device 82 operate in response to actuation of engine control device 18*a* in substantially the same manner as described above with respect to the lawnmower 10*a*. Therefore, when the operator manually operates the engine control device 18*a* by lowering the speed to a point where the ignition ground switch 22 is closed and the interrupt switch 72 is opened (as shown in phantom in FIG. 2), the engine 14 stops running, the fuel vent 58 is closed, and the fuel supply to the carburetor 50 is blocked. When the operator moves the speed control to a position where the ignition ground switch 22 is open and the interrupt switch 72 is closed (as shown in solid lines in FIG. 2), the engine 14 can be started, the vent 58 is opened, and the fuel supply to the carburetor 50 is unblocked.

Figure 3:
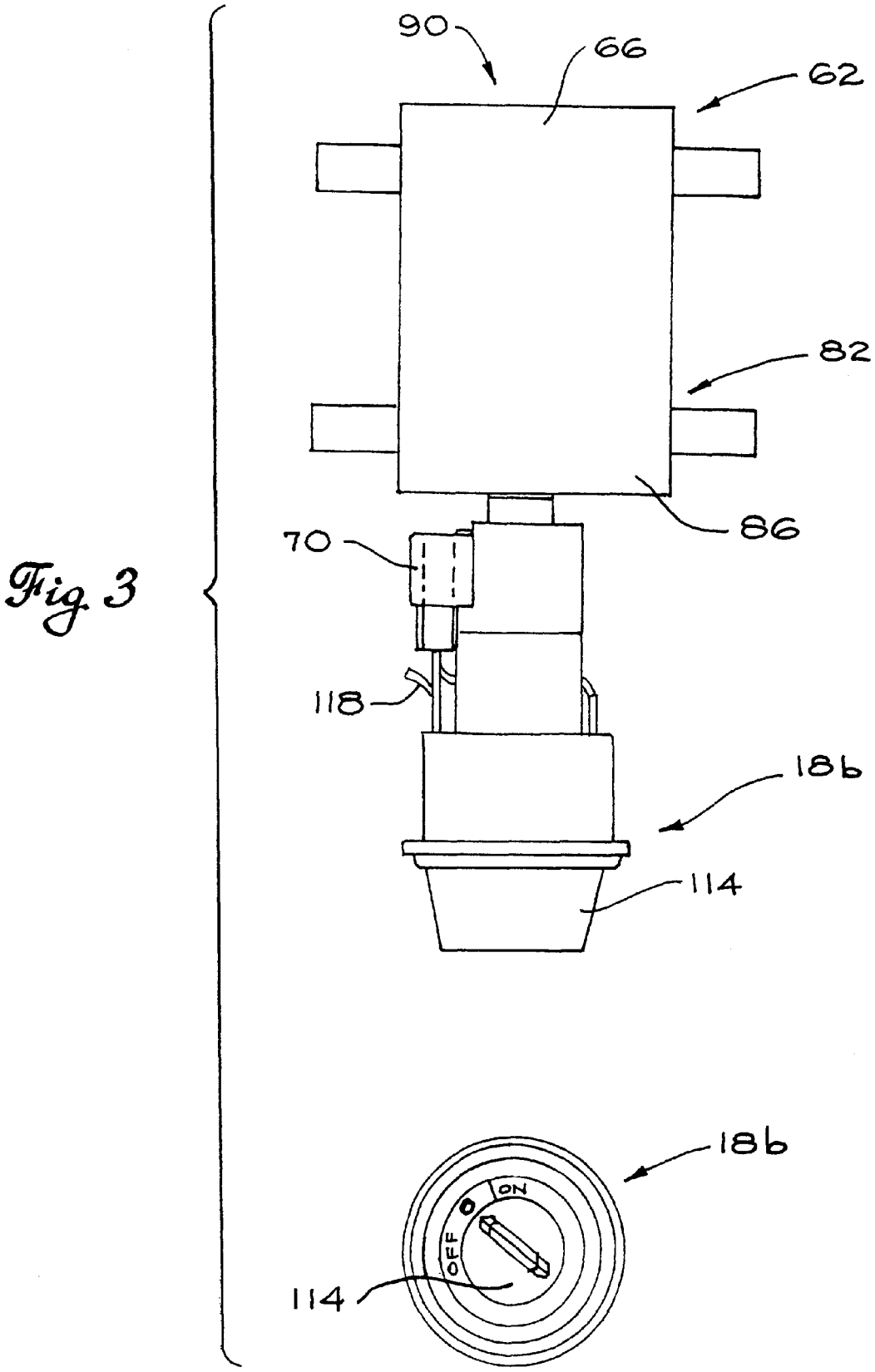
FIG. 3 is a schematic view of another fuel vent closure and fuel shutoff device embodying the invention and coupled to an on/off device.

FIG. 3 schematically illustrates another manner of operating the fuel vent closure device 62 and the fuel shutoff device 82. Specifically, FIG. 3 illustrates a third engine control device 18*b* in the form of an on/off switch. The engine control device 18*b* can be used in conjunction with any devices, including, but not limited to, tractors and riding lawnmowers 10*e* (see FIG. 30), generators 10*b* and 10*d* (see FIGS. 25 and 27), pumps 10*c* (see FIG. 26), and the like.

The engine control device 18*b* can be of any suitable construction. As seen in FIG. 3, the engine control device 18*b* includes a manually actuable knob 114 that is turned by the operator (either by hand or via a key) between the ON and OFF positions. An ignition grounding member 118 is operable to ground the ignition circuit, and thereby stop the running of an engine, when the knob 114 is turned to the OFF position.

The electrical actuator 70 is connected to the power source and is coupled to the valve 66 for the vent closure device 62 and to the valve 86 for the fuel shutoff device 82. The electrical actuator 70 is actuated at the same time that the ignition circuit is activated or deactivated. Therefore, when the operator manually operates the engine control device 18*b* by turning the knob 114 to the OFF position, the engine stops running, the fuel vent is closed, and the fuel supply to the carburetor is blocked. When the operator turns the knob 114 to the ON position, the engine can be started, the vent is opened, and the fuel supply to the carburetor is unblocked.

Figure 4:
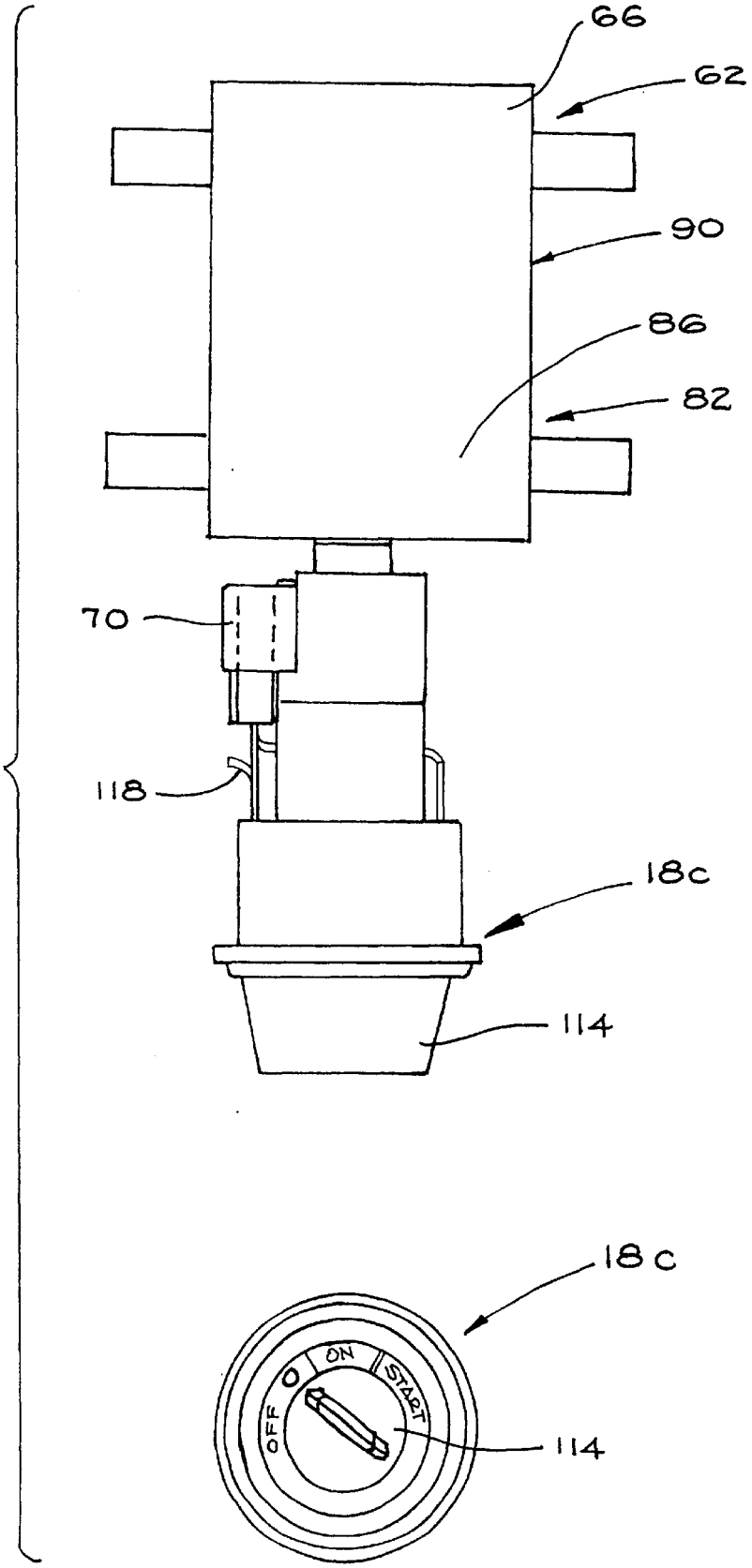
FIG. 4 is a schematic view of the fuel vent closure and fuel shutoff device of FIG. 3 coupled to an on/off/start device.

FIG. 4 schematically illustrates a fourth engine control device 18*c* in the form of an on/off/start switch. The engine control device 18*c* operates in the same manner as the control device 18*b*, but includes a START position for the automatic starting of the engine. When the operator turns the knob 114 to the START position, the engine starts as is understood. Therefore, when the operator manually operates the engine control device 18*c* by turning the knob (either by hand or via a key) 114 to the OFF position, the engine stops running, the fuel vent is closed, and the fuel supply to the carburetor is blocked. When the operator turns the knob 114 to the START position, the engine is automatically started, the vent is opened, and the fuel supply to the carburetor is unblocked. After the engine is started, the knob 114 returns to the ON position where the engine keeps running, the vent remains open, and the fuel supply to the carburetor remains unblocked.

Again, the electrical actuator 70 is switched at the same time as the ignition circuit and is coupled to the valve 66 for the vent closure device 62 and to the valve 86 for the fuel shutoff device 82. Because the engine control device 18*c* is used with devices that already have a power source for automatic starting, no additional power supply 74 is needed for the electrical actuator 70. Rather, the electrical actuator 70 can be electrically connected to the same power source used to start the engine.

It should be noted that tractors and riding lawnmowers 10*e* often include safety interlock switches, normally located under the seat, that sense the presence of the operator. When the operator leaves the seat while the tractor is in use, the safety interlock switch grounds the ignition to stop the engine. Other safety interlock switches may also be used. According to the invention, these safety interlock switches can also be connected to the electrical actuator 70 so that when the operator leaves the seat and/or the engine stops running when the safety interlock switch is tripped, the fuel vent is closed and the fuel supply to the carburetor is blocked.

Figure 5:
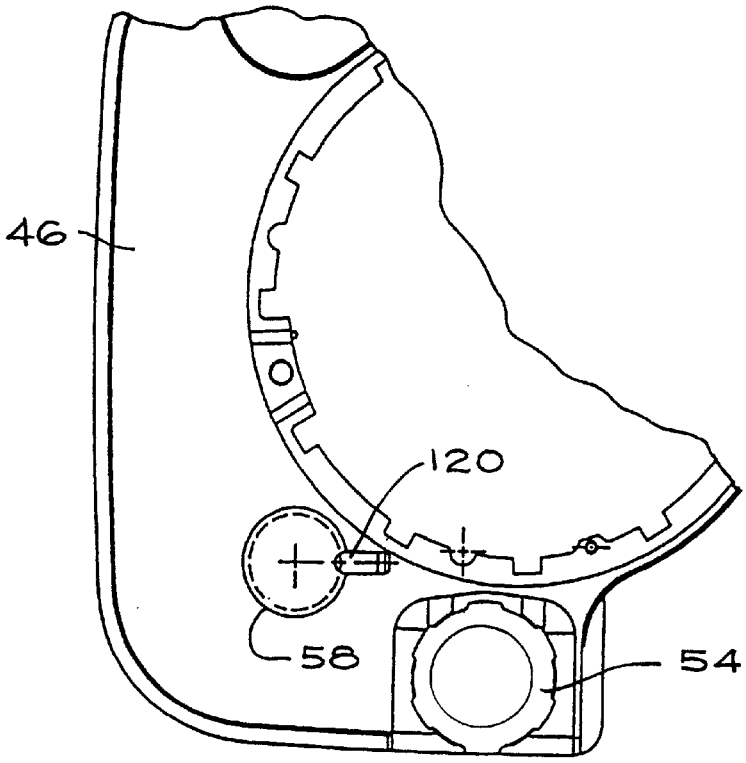
FIGS. 5 and 6 show a fuel tank having a vent and a fuel supply port adapted to be connected to the fuel vent closure and fuel shutoff device.
Figure 6:
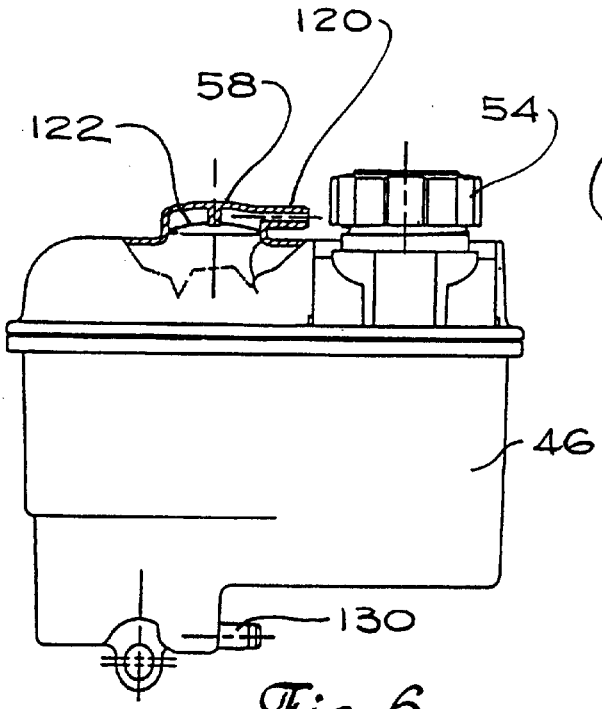

FIGS. 5 and 6 show the fuel tank 46 and fuel tank vent 58 in greater detail. The vent 58 includes a connection port 120 adapted to be coupled to the valve 66 of the fuel vent closure device 62. Any suitable conduit (not shown) can be used to provide communication between the connection port 120 and the valve 66. As best seen in FIG. 6, the vent 58 can also include a baffle 122 that substantially prevents liquid fuel in the tank 46 from splashing out of the connection port 120. The baffle 122 can be any suitable, gasoline-resistant material and is preferably in the form of a disk that has a diameter slightly smaller than the diameter of the vent sidewalls. With this construction, liquid fuel cannot splash into the connection port 120, but air and fuel vapors can pass between the edge of the baffle 122 and the vent sidewalls for venting when the vent 58 is opened. The actual placement and design of the vent 58 in the tank 46 may be different than shown to get optimum separation of liquid and vapor fuel. The vent 58 could also be located in the fuel cap 54.

Figure 7:
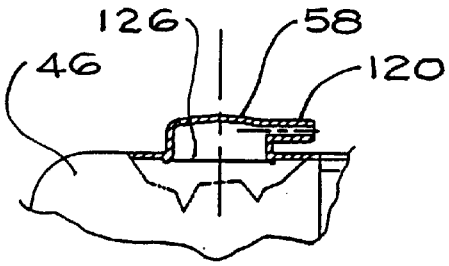
FIG. 7 is a partial view of FIG. 6 showing an alternative vent configuration.

FIG. 7 shows an alternative construction for preventing liquid fuel from splashing out of the connection port 120. The vent 58 includes a gasoline-resistant membrane 126 that is substantially pervious to air and fuel vapor, but is substantially impervious to liquid fuel. When the vent 58 is opened, air and fuel vapor can pass through the membrane 126, but liquid fuel cannot.

FIG. 6 also shows a fuel outlet port 130 located at the bottom of the tank 46. The fuel outlet port 130 is adapted to be connected to a conduit (not shown) that communicates with the valve 86 of the fuel shutoff device 82. It is important to note that the configuration of the fuel tank 46, the vent 58, and the fuel outlet port 130 is not limited to the configurations shown in the figures, but rather can be tailored to work in conjunction with a variety of devices having different types of fuel vent closure devices 62 and fuel shutoff devices 82.

Figure 8:
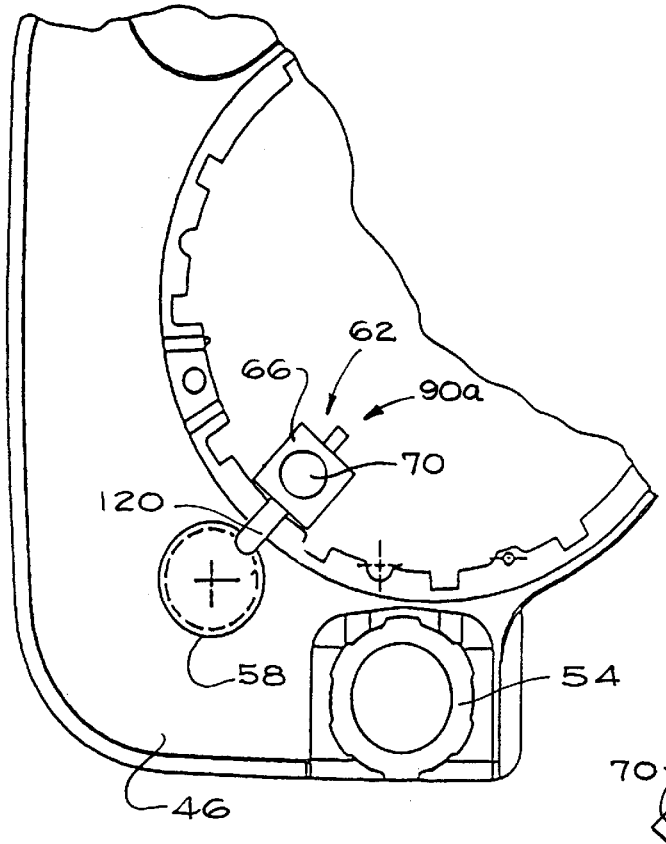
FIGS. 8 and 9 show a mounting arrangement for the fuel vent closure and fuel shutoff device.
Figure 9:
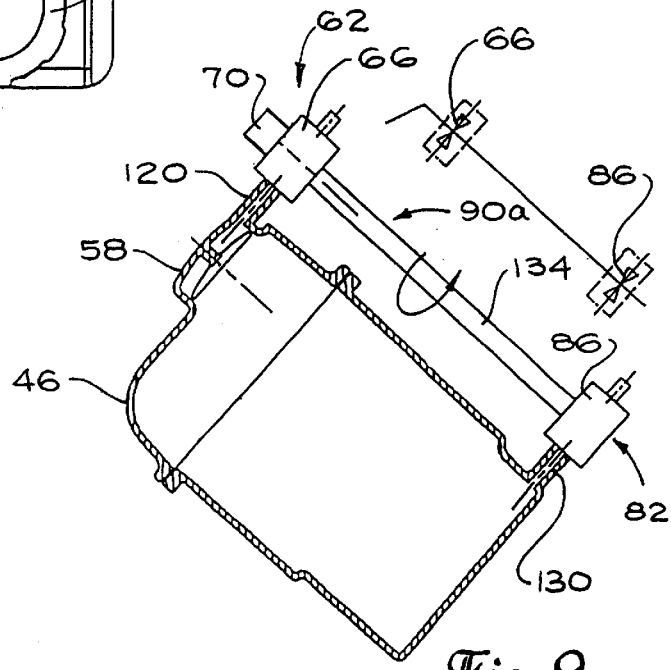

For example, FIGS. 8 and 9 illustrate an alternative embodiment wherein the connection port 120 and the fuel outlet port 130 extend substantially parallel to one another in the same plane. Instead of using conduit to connect the ports 120 and 130 to the respective valves 66 and 86, the valves 66 and 86 may be directly connected to the respective ports 120 and 130 outside of the fuel tank 46 as shown. The vent closure device 62 and the fuel shutoff device 82 may be part of a single valve assembly 90*a*, as shown, or alternatively may be two interconnected valve assemblies (not shown). The valves 66 and 86 are connected via a shaft 134 which rotates in response to actuation of the electrical actuator 70 to open and close the valves 66 and 86. In FIGS. 8 and 9, the electrical actuator 70 is illustrated as an electric motor, such as a stepper motor, that is capable of rotating the shaft 134.

Figure 10:
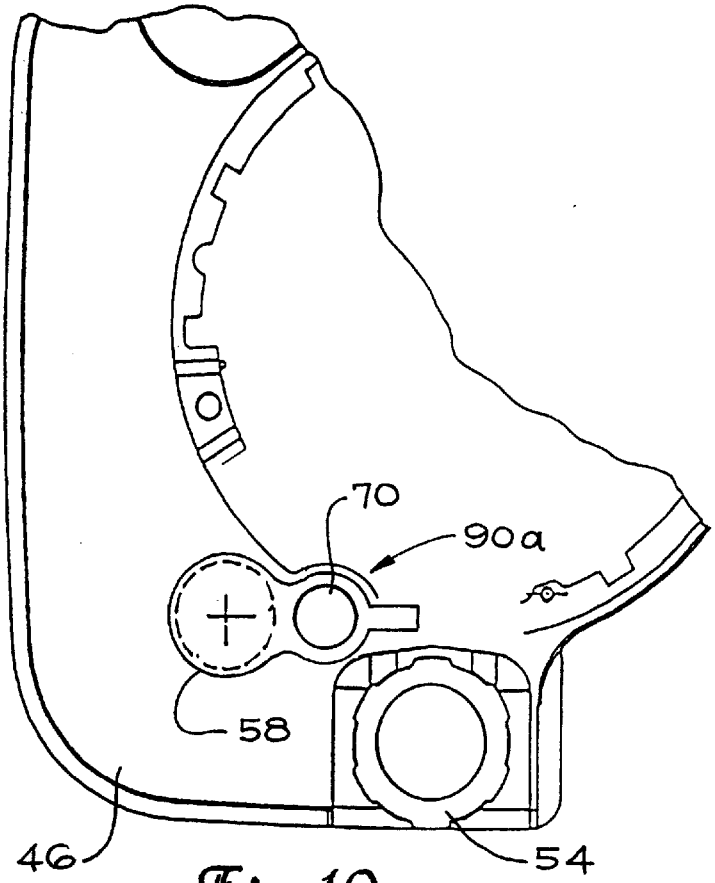
FIGS. 10 and 11 show an alternative mounting arrangement for the fuel vent closure and fuel shutoff device.
Figure 11:
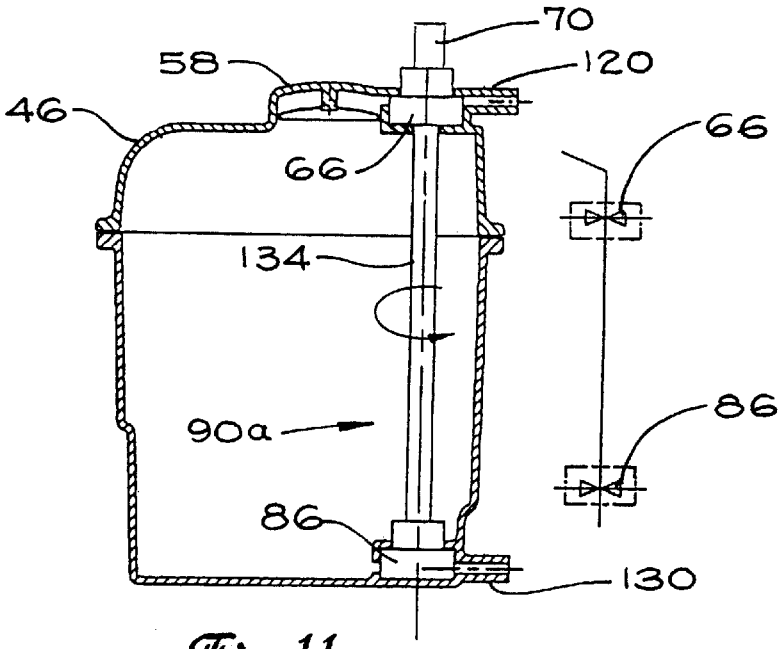

FIGS. 10 and 11 illustrate an alternative embodiment wherein the valve assembly 90*a* is located at least partially inside the fuel tank 46. By positioning the valve assembly 90*a* inside the fuel tank 46, the number of parts can be reduced. Any suitable method of securing the valve assembly 90*a* inside the fuel tank 46 can be used. With this embodiment, the valve 66 is part of the vent 58 so that vapors escaping the tank 46 pass through the valve 66 prior to exiting the connection port 120. Likewise, air drawn into the tank 46 enters the connection port 120 prior to passing through the valve 66. The valve 86 is also inside the fuel tank 46 such that fuel passes through the valve 86 prior to exiting through the fuel outlet port 130.

Figure 12:
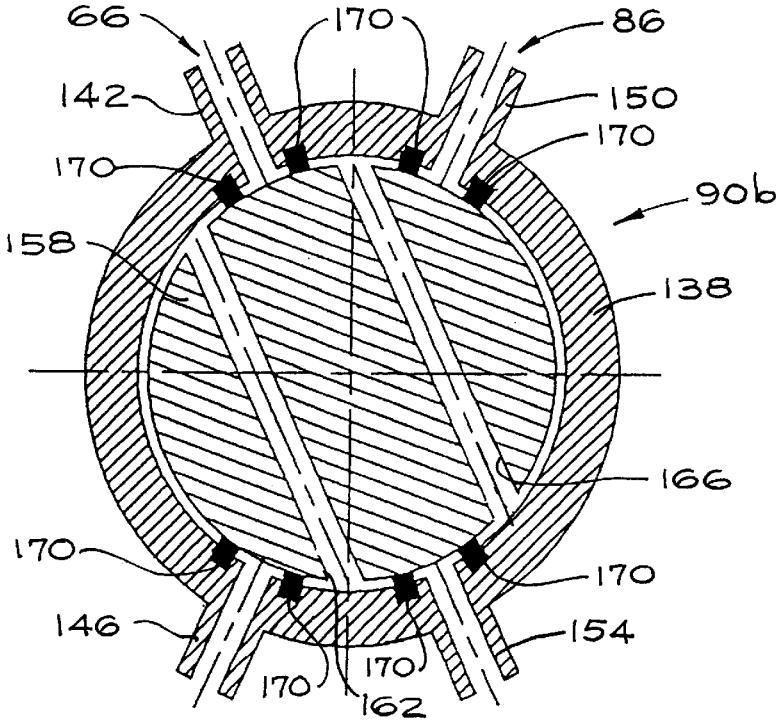
FIGS. 12 and 13 show a valve design that can be used for the fuel vent closure and fuel shutoff device.
Figure 13:
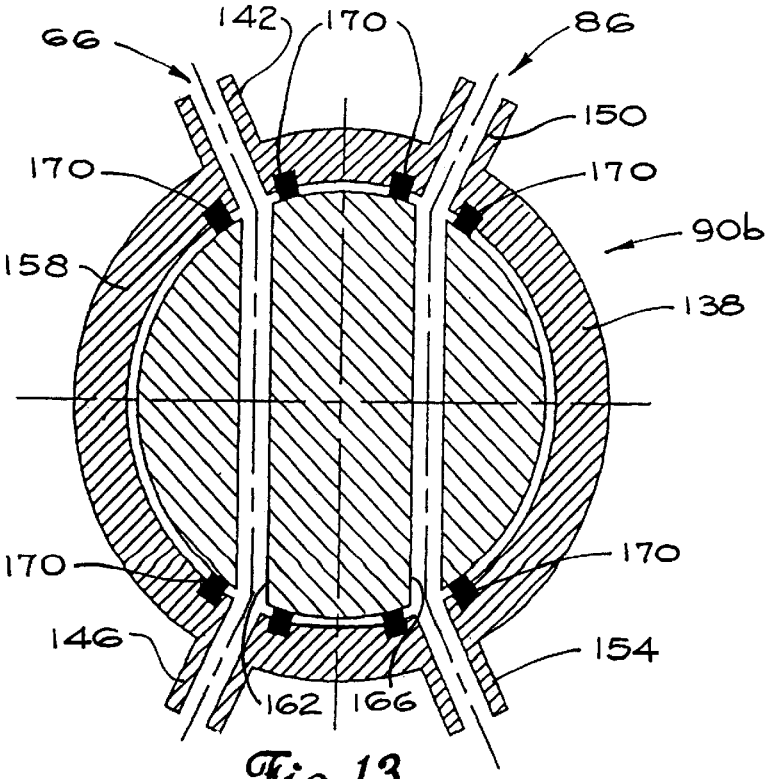

There are numerous possible designs available for the valves 66 and 86, and for the valve assembly 90. For example, FIGS. 12 and 13 illustrate one type of rotary valve assembly 90*b* that could be used. The valve assembly 90*b* includes an outer sleeve 138 having a vapor inlet 142, a vapor outlet 146, a fuel inlet 150, and a fuel outlet 154. It should be noted that the terms "vapor inlet" and "vapor outlet" are given with respect to the direction at which fuel vapor flows out of the tank 46, however, if air from the surroundings is flowing into the tank 46, the vapor outlet acts as an air inlet and the vapor inlet acts as an air outlet.

A rotatable shaft 158 is housed inside the outer sleeve 138. The shaft 158 includes two transverse holes extending therethrough. Hole 162 selectively provides fluid communication between the vapor inlet 142 and the vapor outlet 146, thereby acting as the valve 66, while hole 166 selectively provides fluid communication between the fuel inlet 150 and the fuel outlet 154, thereby acting as the valve 86. Seals 170 are positioned between the sleeve 138 and the shaft 158 to seal the gap between the sleeve 138 and the shaft 158.

As seen in FIG. 12, when the engine is not in operation, the shaft 158 is rotated such that the holes 162 and 166 are not aligned with the respective inlets 142, 150 and outlets 146, 154. In this position, no air or fuel vapor can pass through the valve 66 and no fuel can pass through the valve 86. The orientation shown in FIG. 12 is used when the engine is not operating. In FIG. 13, the shaft 158 is rotated such that the holes 162 and 166 provide fluid communication between the respective inlets 142, 150 and outlets 146, 154. The orientation shown in FIG. 13 is used during times of engine operation.

While the valve assembly 90*b* shown in FIGS. 12 and 13 is illustrated with the inlets 142, 150, the outlets 146, 154, and the holes 162, 166 all being in the same plane, it should be understood that the components of the valve 66 and the valve 86 can be in different planes as well. Such would be the case when the valve assembly 90*b* were used with the embodiments shown in FIGS. 8–11. Of course, with the valves 66 and 86 in different planes, the inlets 142, 150 and the outlets 146, 154 could be positioned anywhere along the circumferential periphery of the sleeve 138 to suit the configuration of the tank 46 and the ports 120, 130.

Figure 14:
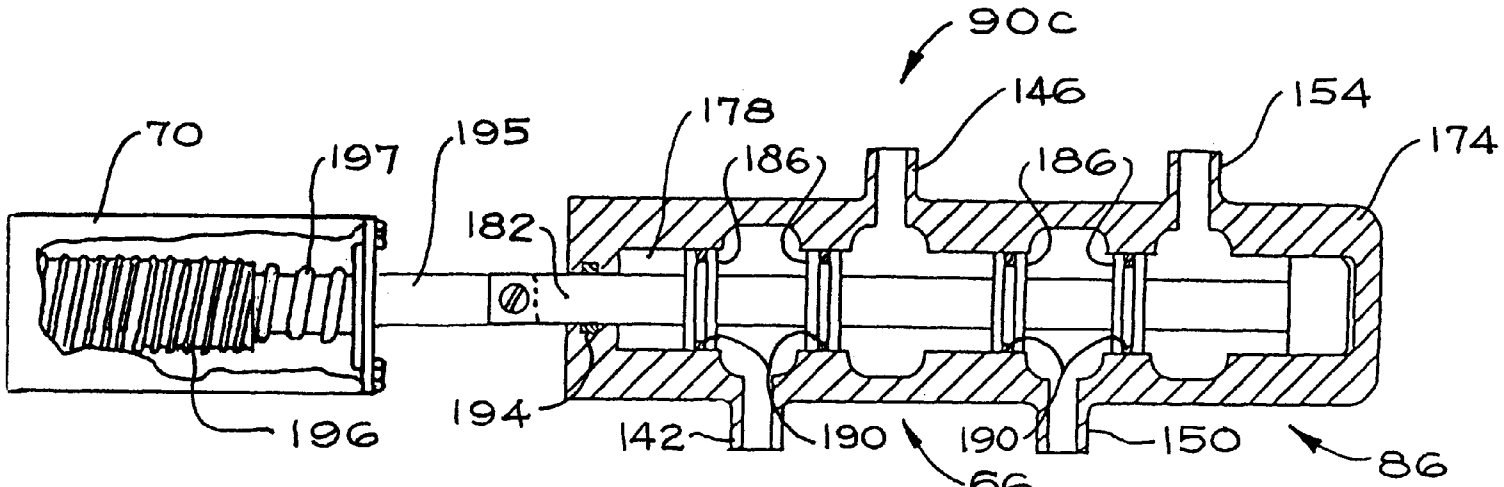
FIGS. 14 and 15 show another valve design that can be used for the fuel vent closure and fuel shutoff device.
Figure 15:
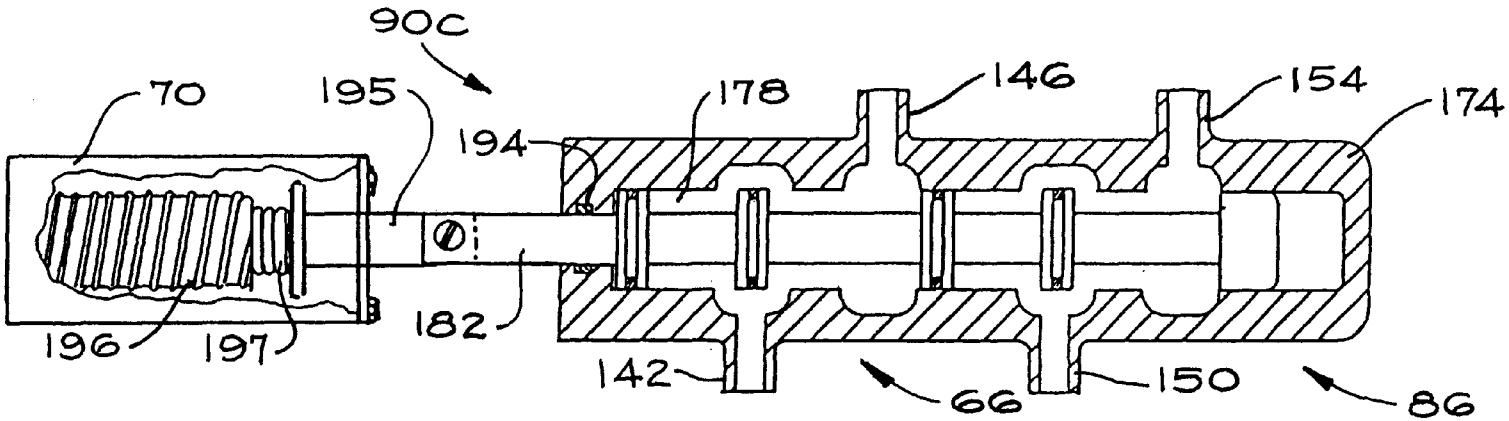

FIGS. 14 and 15 illustrate another valve assembly 90*c*. The valve assembly 90*c* is a schematic of a sliding-spool directional-flow valve and includes an outer shell 174 having inlets 142, 150 and outlets 146, 154 that communicate with an inner cavity 178. The inner cavity 178 is open at one end for slidably receiving the end of a spool 182. The spool 182 includes four sealing disks 186 mounted in spaced relation from one another. Each of the disks 186 includes a seal ring 190 that can engage portions of the cavity wall as shown to selectively seal off portions of the cavity 178 between the disks 186.

The spool 182 is slidable into and out of the cavity 178 as seen in FIGS. 14 and 15. A wiper seal 194 adjacent the open end of the cavity 178 seals the open end of the cavity 178 to substantially prevent vapors and fuel from leaking out between the spool 182 and the shell 174 during operation. FIG. 14 illustrates the closed position for the valves 66 and 86 and FIG. 15 illustrates the open position for the valves 66 and 86.

In FIGS. 14 and 15, the electrical actuator 70 is illustrated as a solenoid that is capable of sliding the spool 182 into and out of the cavity 178. The solenoid 70 includes a plunger 195 coupled to the spool 182. It is to be understood that the plunger 195 can be coupled to the spool 182 in any suitable manner. The plunger 195 is surrounded by a coil 196. When the coil 196 is energized (see FIG. 15), the plunger 195 retracts and the spool 182 moves to the left (as seen in FIG. 15). When the coil 196 is de-energized, the plunger 195 is biased to the right (as seen in FIG. 14) by a biasing spring 197.

Figure 16:
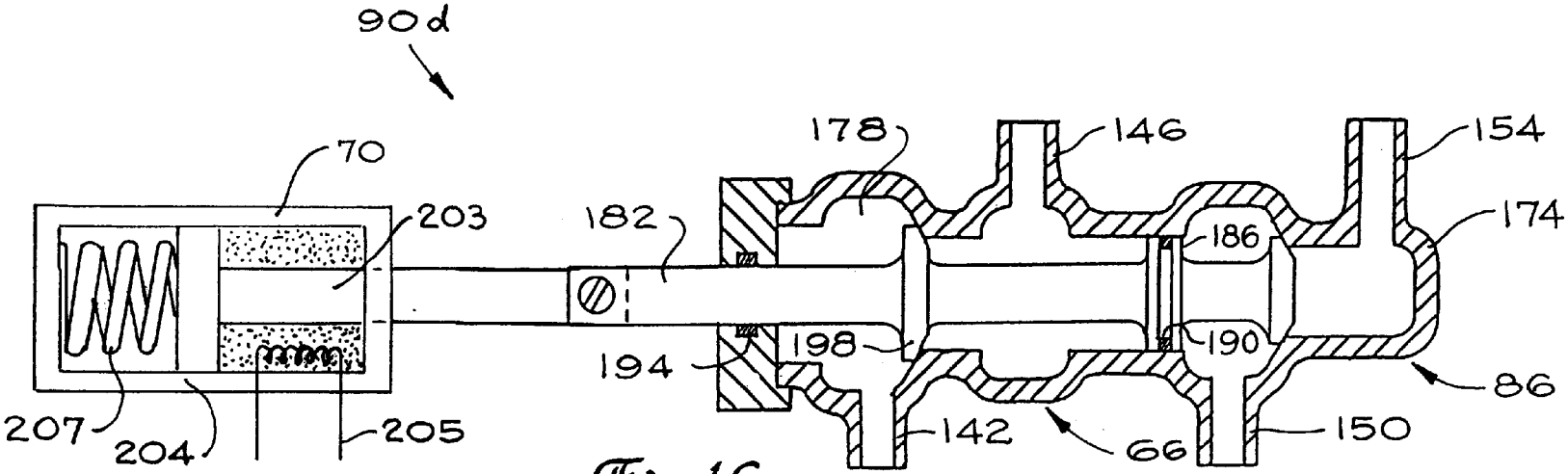
FIGS. 16 and 17 show yet another valve design that can be used for the fuel vent closure and fuel shutoff device.
Figure 17:
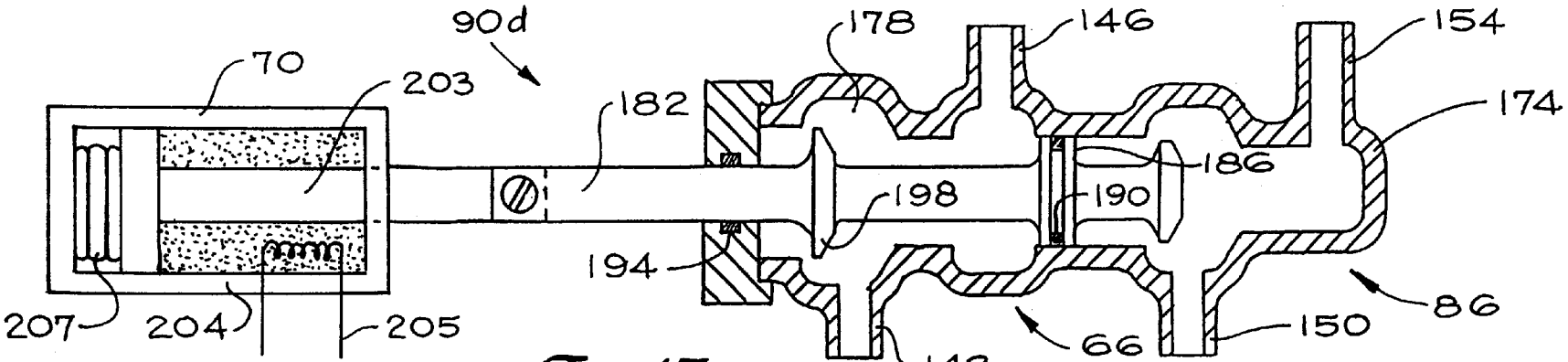

FIGS. 16 and 17 illustrate a valve assembly 90*d* that is a schematic of a poppet valve. The operation of the valve assembly 90*d* is similar to the operation of the valve assembly 90*c* and like parts have been given like reference numerals. Instead of four disks 186, the spool 182 has only one disk 186. In addition to the single disk 186, poppets 198 formed on the spool 182 engage portions of the cavity wall to selectively seal off portions of the cavity 178 between the poppets 198 and the disk 186. A separate end cap 202 closes the end of the cavity 178 and includes the wiper seal 194. FIG. 16 illustrates the closed position for the valves 66 and 86 and FIG. 17 illustrates the open position for the valves 66 and 86.

In FIGS. 16 and 17, the electrical actuator 70 is illustrated as a wax motor that is capable of sliding the spool 182 into and out of the cavity 178. Wax motors are known by those skilled in the art and typically include a plunger 203 housed in a cylinder 204 containing wax or another material having a high coefficient of thermal expansion. The plunger 203 is coupled to the spool 182. It is to be understood that the plunger 203 can be coupled to the spool 182 in any suitable manner. A heating element 205 is positioned inside the cylinder 204 to heat the wax. When the wax is heated, it expands and moves the plunger 203 to the position shown in FIG. 17, thereby opening the valve 90*d*. When power is interrupted from the heating element 205, the wax contracts and a biasing spring 207 pushes the plunger 203 to the position shown in FIG. 16, thereby closing the valve 90*d*.

Figure 18:
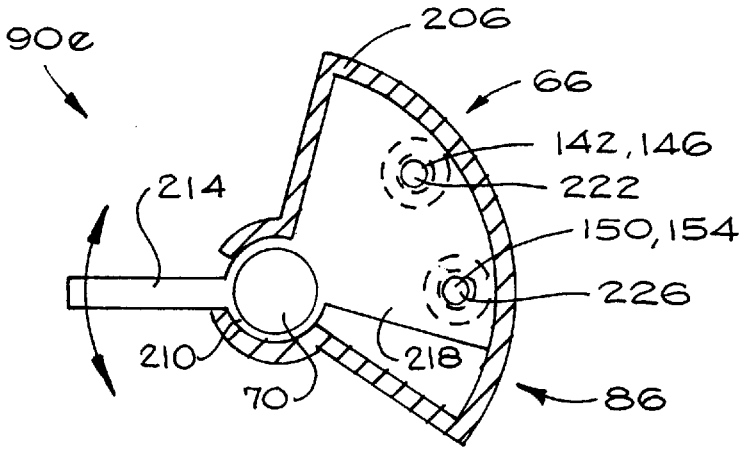
FIGS. 18–20 show yet another valve design that can be used for the fuel vent closure and fuel shutoff device.
Figure 19:
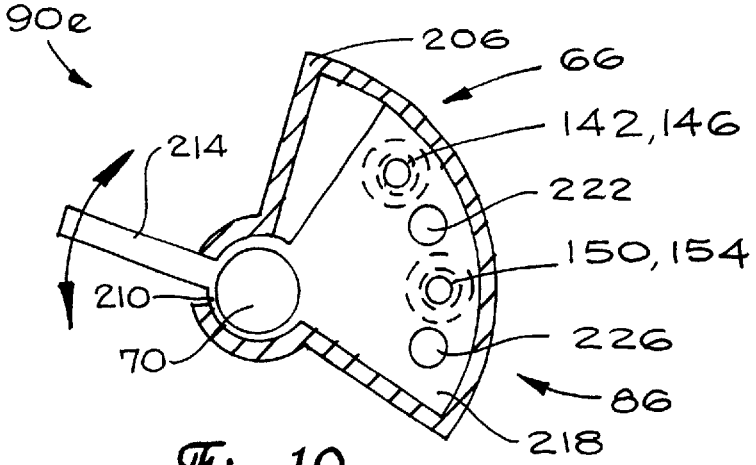
Figure 20:
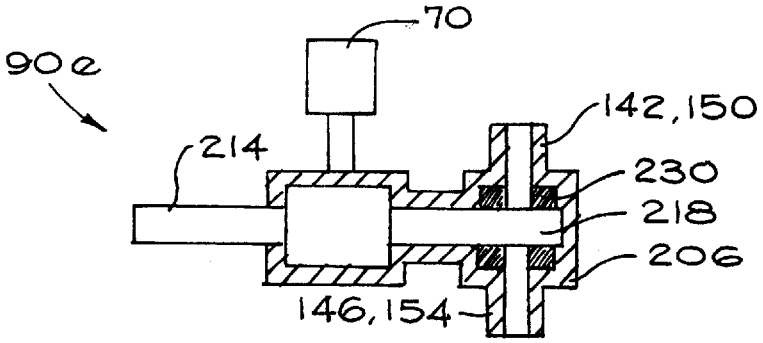

FIGS. 18–20 illustrate yet another valve assembly 90*e*. The valve assembly 90*e* is a schematic of an axial-sealing rotary valve and includes a housing 206 defining the inlets 142, 150 and the outlets 146, 154. A rotary member 210 is positioned within the housing 206 and rotates with respect to the housing 206 by actuation of the electrical actuator 70 (shown in FIGS. 18–20 as being an electric stepper motor). An optional lever arm 214 is also shown and can be used to manually rotate the rotary member 210 in the event the electrical actuator 70 is non-functional. The rotary member 210 also includes a valve segment 218 having a vent aperture 222 and a fuel aperture 226 that selectively provide communication between the respective inlets 142, 150 and outlets 146, 154. Seals 230 are provided between the valve segment 218 and the housing 206.

When the valves 66 and 86 are in the open position, as shown in FIG. 18, the apertures 222 and 226 are aligned with the respective inlets 142, 150 and outlets 146, 154 to provide fluid communication therebetween. When the valves 66 and 86 are in the closed position, as shown in FIGS. 19 and 20, the apertures 222 and 226 are not aligned with the respective inlets 142, 150 and outlets 146, 154 and fluid communication is blocked.

Figure 21:
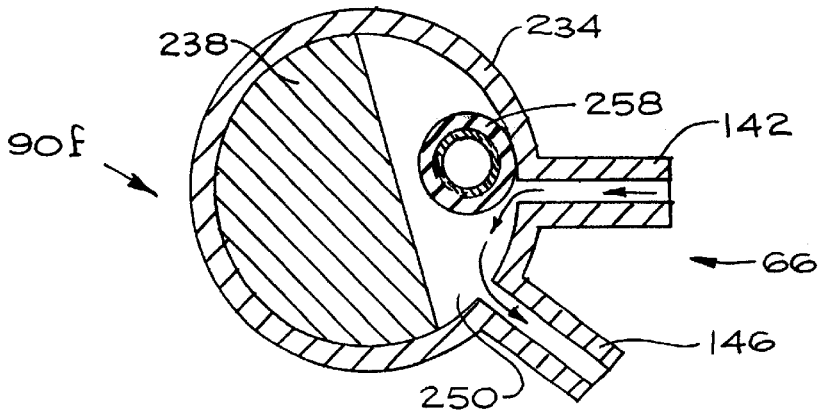
FIGS. 21–23 show yet another valve design that can be used for the fuel vent closure and fuel shutoff device.
Figure 22:
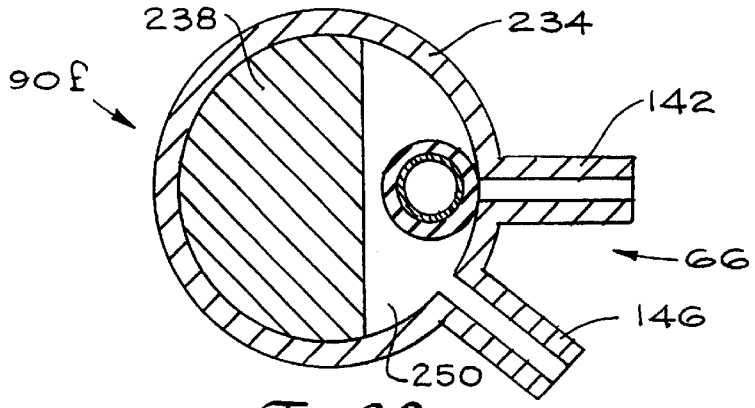
Figure 23:
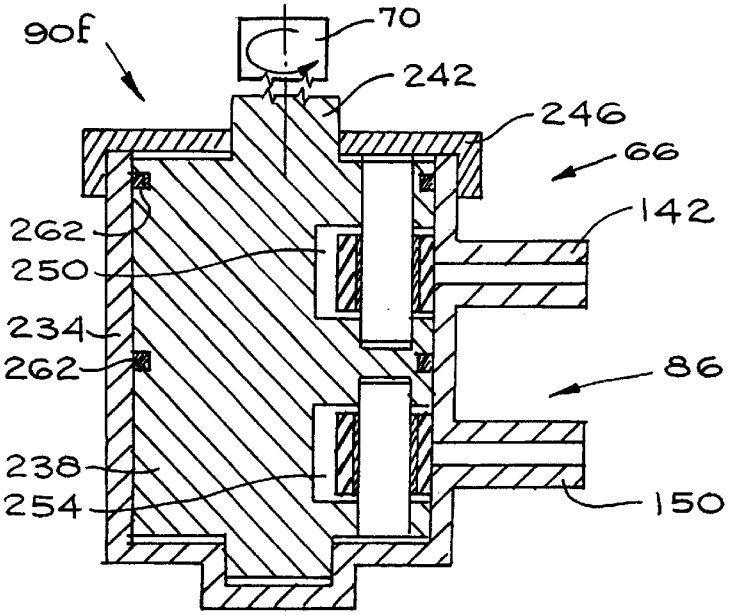

FIGS. 21–23 illustrate yet another valve assembly 90*f*. The valve assembly 90*f* is an eccentric wheel valve and includes a housing 234 having inlets 142, 150 and outlets 146, 154. A rotary member 238 is positioned inside the housing 234 and has an actuating portion 242 (see FIG. 23) extending out of the housing 234 through an end cap 246. The rotary member 238 includes upper and lower recesses 250 and 254, respectively.

A blocking member 258 is pinned in each of the recesses 250 and 254 and rolls along the inner wall of the housing 234 to selectively block and unblock the inlets 142, 150 as the rotary member 238 rotates. Of course the blocking members 250 could also be positioned to selectively block and unblock the outlets 146, 154. Seals 262 (see FIG. 23) isolate the recesses 250 and 254 from one another and from the environment outside of the housing 234. FIG. 21 illustrates the open position for the valves 66 and 86 and FIGS. 22 and 23 illustrate the closed position for the valves 66 and 86. In FIG. 23, the electrical actuator 70 is illustrated as an electric motor, such as a stepper motor, that is capable of rotating the rotary member 238.

Each of the valve assemblies 90 discussed above can be made from any suitable fuel-resistant materials and can be used interchangeably if the design of the device 10 so permits. It is understood that modifications to the tank 46 and the valve actuating linkages may be required depending on the type of valve assembly 90 used. Alternatively, changes to the valve assemblies 90 can be made to suit the tank and the actuating linkage configurations. It should also be noted that other valve assemblies 90 not shown or described can also be substituted. For example, while the valves 66 and 86 are shown to typically open and close at the same time, alternative arrangements can be substituted where the vent valve 66 may be positioned or timed to open prior to the fuel valve 86, or vice-versa. Furthermore, the valve assemblies 90 need not incorporate both of the valves 66 and 86 as shown. Two separate valves 66 and 86 could be used and could incorporate any of the valve types discussed above.

The different types of electrical actuators 70 illustrated in the figures represent only a few of the types of electrical actuators 70 that can be used. Those skilled in the art would recognize other forms of electrical actuators that could be substituted. Additionally, those skilled in the art would understand that by incorporating known methods of converting rotary motion to linear motion, the direct rotary output of the electric motor could be also be used generate the linear actuation needed for the valve assemblies shown in FIGS. 14–17. Likewise, the direct linear output of the solenoid and the wax motor could also be used to generate the rotary actuation needed for the various rotary valves. For example, the wax motor or the solenoid could be coupled to the lever arm 214 of the valve assembly 90*e* (see FIGS. 18–20) to generate rotation of the rotary member 210.

Various features of the invention are set forth in the following claims.

What is claimed is:

1. A device comprising:

an internal combustion engine;

an engine control device manually operable to stop operation of the engine;

a fuel tank that provides fuel to the engine, the fuel tank including a vent; and a fuel vent closure device automatically and electrically operable in response to the manual operation of the engine control device to substantially seal the vent when the engine is stopped;

wherein said fuel vent closure device includes an eccentric wheel valve including a valve housing;

a rotary member inside said housing; and an actuating portion extending out of said valve housing.

2. The device of claim 1, wherein the fuel vent closure device is electrically actuated via an electrical actuator.

3. The device of claim 2, wherein the electrical actuator is a stepper motor.

4. The device of claim 2, wherein the electrical actuator is a wax motor.

5. The device of claim 2, wherein the electrical actuator is a solenoid.

6. The device of claim 1, wherein the engine control device is also manually operable to permit start-up of the engine, and wherein the fuel vent closure device is automatically and electrically operable in response to the manual operation of the engine control device to vent the fuel tank.

7. The device of claim 1, wherein the engine control device is coupled to the ignition circuit and is operable to stop operation of the engine by grounding the ignition circuit.

8. The device of claim 1, wherein the engine control device is remote from the engine and wherein the manual operation of the engine control device causes remote actuation of the vent closure device.

9. The device of claim 1, wherein the device is a lawnmower.

10. The device of claim 9, further including:

a blade rotatable by the engine; and a brake automatically operable in response to the manual operation of the engine control device to substantially stop rotation of the blade when the engine is stopped.

11. The device of claim 1, wherein the device is a pressure washer.

12. The device of claim 1, wherein the device is a portable generator.

13. The device of claim 1, wherein the device is an automatic backup power system.

14. The device of claim 1, wherein the device is at least one of a tractor and a riding lawnmower.

15. The device of claim 1, wherein the internal combustion engine is a multi-cylinder engine.

16. The device of claim 1, wherein the internal combustion engine is a single-cylinder engine.

17. The device of claim 1, further comprising:

a fuel shutoff device automatically and electrically operable in response to the manual operation of the engine control device to substantially block the supply of fuel to the engine when the engine is stopped.

18. The device of claim 17, wherein the fuel shutoff device is a valve.

19. The device of claim 17, wherein the fuel vent closure device and the fuel shutoff device are combined into a single assembly.

20. The device of claim 17, wherein the engine control device is also manually operable to permit start-up of the engine, wherein the fuel vent closure device is automatically and electrically operable in response to the manual operation of the engine control device to vent the fuel tank and permit engine start-up, and wherein the fuel shutoff device is automatically and electrically operable in response to the manual operation of the engine control device to unblock the supply of fuel to the engine and permit engine start-up.

21. The device of claim 17, wherein the engine control device is remote from the engine and wherein the manual operation of the engine control device causes remote actuation of the vent closure device and the fuel shutoff device.

22. A method of automatically and substantially preventing vapor emissions from a fuel tank communicable with an internal combustion engine, the fuel tank and engine being interconnected with a device having an engine control device operable to stop operation of the engine, the method comprising:

operating the engine; and manually activating the engine control device to stop operation of the engine and to electrically and substantially seal the fuel tank;

wherein said manual activating step includes:

providing an eccentric wheel valve having a valve housing, a rotating member and an actuating portion extending out of the valve housing; and rotating the actuating portion to move said rotating member.

23. The method of claim 22, wherein the engine control device is interconnected with the ignition circuit and wherein manually activating the engine control device stops operation of the engine by grounding the ignition circuit.

24. The method of claim 22, further comprising:

after stopping the engine, manually activating the engine control device to allow operation of the engine and to vent the fuel tank.

25. The method of claim 22, wherein manually activating the engine control device includes automatically and electrically activating a fuel vent closure device via an electrical actuator coupled to the engine control device.

26. The method of claim 25, wherein the electrical actuator is a stepper motor.

27. The method of claim 25, wherein the electrical actuator is a wax motor.

28. The method of claim 25, wherein the electrical actuator is a solenoid.

29. The method of claim 25, wherein manually activating the engine control device further includes automatically and electrically activating a fuel shutoff device via an electrical actuator coupled to the engine control device.

30. The method of claim 29, wherein the electrical actuator is a stepper motor.

31. The method of claim 29, wherein the electrical actuator is a wax motor.

32. The method of claim 29, wherein the electrical actuator is a solenoid.

33. The device of claim 1, further comprising:

a baffle that substantially prevents fuel from splashing out of the fuel tank.

34. The method of claim 22, further comprising:

providing a baffle adjacent said fuel tank that prevents fuel from splashing out of the fuel tank.

35. A device comprising:

an internal combustion engine having an ignition circuit;

an on/off switch manually movable between an ON position, wherein the engine is permitted to operate, and an OFF position, wherein the engine is prevented from operating;

an ignition grounding member connected to the on/off switch and operable to ground the ignition circuit when the on/off switch is moved to the OFF position, thereby preventing operation of the engine, and operable to permit engine operation when the on/off switch is moved to the ON position;

a fuel tank that provides fuel to the engine, the fuel tank including a vent; and a fuel vent closure device automatically and electrically operable to substantially close the vent in response to movement of the on/off switch to the OFF position.

36. The device of claim 33, wherein the fuel vent closure device is automatically and electrically operable to open the vent in response to movement of the on/off switch to the ON position.

37. The device of claim 35, wherein the fuel vent closure device is a valve.

38. The device of claim 37, wherein the valve is a rotary valve.

39. The device of claim 38, wherein the valve is an axial-sealing rotary valve.

40. The device of claim 38, wherein the valve is an eccentric-wheel valve.

41. The device of claim 35, wherein the fuel vent closure device is electrically actuated via an electrical actuator that is electrically connected to a power supply.

42. The device of claim 35, wherein the on/off switch is further movable to a START position wherein the engine is automatically started.

43. The device of claim 35, further comprising:

a fuel shutoff device automatically and electrically operable in response to the manual operation of the on/off switch to substantially block the supply of fuel to the engine when the on/off switch is in the OFF position.

44. The device of claim 43, wherein the fuel shutoff device is automatically and electrically operable in response to manual operation of the on/off switch to substantially unblock the supply of fuel to the engine when the on/off switch is in the ON position.

45. The device of claim 43, wherein the fuel vent closure device and the fuel shutoff device are combined into a single assembly.

46. The device of claim 35, wherein the device is at least one of a tractor and a riding lawnmower.

47. The device of claim 18, wherein the valve is a rotary valve.

48. The device of claim 47, wherein the valve is an eccentric-wheel valve.

49. The device of claim 37, wherein the valve is a sliding-spool directional-flow valve.

50. The device of claim 37, wherein the valve is a poppet valve.

* * * * *